US005996917A

United States Patent [19]

Ehrle et al.

[11] Patent Number: 5,996,917

[45] Date of Patent: Dec. 7, 1999

[54] BOWL CUTTER KNIFE

[76] Inventors: Egon Ehrle, Breestpromenade 25, D-12587 Berlin; Eberhard Haack, Martha-Brautzsch-Strasse8, D-06108 Halle; Juergen Wilke, Trautmannstrasse 1, D-06366 Koethen, all of Germany

[21] Appl. No.: 09/000,730

[22] Filed: Dec. 30, 1997

[30] Foreign Application Priority Data

Dec. 30, 1996 [DE] Germany ..... 196 54 733

[51] Int. Cl.[6] ..... B02C 18/16

[52] U.S. Cl. ..... 241/292.1

[58] Field of Search ..... 241/91, 92, 93, 241/292.1; 83/171, 663, 835

[56] References Cited

U.S. PATENT DOCUMENTS 2,081,807 5/1937 Gabriel ..... 241/292.1

3,083,922 4/1963 Enright et al. ..... 241/292.1

FOREIGN PATENT DOCUMENTS 1075458 2/1960 Germany ..... 241/292.1

4015662 7/1991 Germany ..... 241/292.1

*Primary Examiner*—Mark Rosenbaum

*Attorney, Agent, or Firm*—Karl Hormann

[57] ABSTRACT

The invention relates to a cutter knife adapted to be mounted on a rotatably drivable knife shaft of a meat cutter machine. The blade of the knife is provided with at least one convexly configured margin with a cutting edge therein and a plurality of openings disposed in predetermined relationship relative to the cutting edge, the openings being in longitudinal section of substantially concave configuration and reduce the mass and surface area of the blade from about 15% to about 30% and from about 20% to 50%, respectively, thereby reducing heat accumulation and retention in the blade.

9 Claims, 4 Drawing Sheets

BOWL CUTTER KNIFE

BACKGROUND OF THE INVENTION

1. Field of the Invention

The present invention, in general, relates to a bowl cutter knife for use with the knife head of a bowl cutter machine and, more particularly, to a bowl cutter knife of the kind having a substantially convexly curved cutting edge.

2. The Prior Art

Curved bowl cutter knives are well-known for cutting or chopping sausage meat and the like. At one end, the blade of such knives with their convexly curved cutting edge is provided with a tang or other suitable means for mounting it on a rotary knife shaft of a bowl cutter machine.

So-called bowl cutter machines are used for the production of sausage meat and the like. They consist of a rotary bowl of suitable capacity for receiving the meat and of a knife head attached to a rotary knife shaft. The knives of the rotary knife head are aligned relative to the internal wall or walls of the bowl such that they may chop and mix the meat within the bowl. Conventionally, the knives are driven at speeds up to 5,000 r.p.m. While the position of the knife is substantially stationary, the bowl and the contents therein rotate relative to the knives whereby the contents are continuously moved against the knives as the bowl is rotating.

The essential aspects of the cutting operation are the cutting action itself and the emulsifying action of the knife blades, whereby the raw material is usually emulsified with water. To this end, a predetermined quantity of ice and/or water is added to the sausage dough within the bowl which is then worked into the dough by the rotating knives in order to yield a sausage dough of as uniform a granular consistency and homogeneity or appearance as possible. In addition to providing as great a cutting efficiency as possible, it is important to produce a stable emulsion. In the event, the cutting blades exert a certain amount of friction upon the meat particles which leads to the generation of considerable heat. The heat developed during the cutting operation may rise significantly and lead to knife surface temperatures as high as 100° C. However, the denaturation temperature of protein is about 40° C. Consequently, thin films of the sausage dough may denature at or on the cutting blades and diffuse or penetrate into the sausage dough.

In order to limit the development of heat as much as possible during the cutting process, knives of various structures have been used. Thus, German patent 4,214,730 C2 discloses a cutter knife provided at its lateral surfaces with grooves and undulations extending arcuately with a radius substantially the same as the radius of the cutting blade. The grooves and undulations on the lateral surfaces of the knife are intended not to affect the emulsifying action in the emulsification zone. Frictional heat is intended to be reduced by the arrangement and disposition of the grooves and undulations, and the purpose of the concentric disposition of the undulations and grooves is to prevent a jagged cutting edge as a result of regrinding the cutting edge.

Another cutter knife is known from German patent 4,339,496. The knife is structured to provide a longitudinally extending channel at the rear edge of the blade, the channel being connected to a fluid conduit provided in the knife mounting chuck and provided with a fluid outlet at the rear margin of the blade. Water flowing in the channel is intended to cool the knife surface for reducing the temperature in the vicinity of the operation. This cutter knife is also convexly curved and is provided with a forwardly disposed cutting edge, i.e. in the direction of rotation, the rear edge of the knife being of concave configuration. The mentioned channel is provided in the concave edge.

The hitherto known cutter knives suffer from the drawback of the meat to be cut engaging, or adhering to, the entire lateral surfaces of the cutter knife, thus forming a certain sausage dough film thereon which detrimentally affects the cutting process and results in denaturization of the meat.

Prior publications, such as German patents 421,512; 629,843 and 676,550 disclose cutter knives provided with openings in their lateral surfaces. The openings are structured to provide additional cutting edges and to influence the kneading of the meat to be chopped.

The innovation disclosed by German utility model 1,802,811 relates to a cutter knife for a meat cutter. In the vicinity of its cutting portion the knife is provided with a slot-like notch extending substantially parallel to the cutting edge which is intended to function as an additional cutting edge.

These solutions aim at increasing the number of cutting edges of the disclosed cutter knives and at bringing about partially improved kneading of the masses to be chopped. They do, however, affect the diminution process and the quality of the material to be chopped in an extremely detrimental manner which in the final analysis also has a negative influence on the thermal load of the sausage dough.

OBJECTS OF THE INVENTION

It is a general object of the invention to provide a novel cutter knife which avoids the disadvantage of prior art knives.

A more specific object of the invention is to provide a cutter knife which leads to meat products of improved quality.

A still further object of the invention is to provide a cutter knife which contributes to the cooling and mixing of the meat product.

Yet another object of the invention is to provide a cutter knife which significantly reduces the otherwise high thermal load of the sausage dough.

SUMMARY OF THE INVENTION

In accordance with a currently preferred embodiment of the invention there is provided a cutter knife for the knife head of a bowl cutter for producing sausage dough and the like which in its lateral surfaces is provided with openings extending transversely of the cutting edge of the cutter knife and which are structured as flow-through channels the transition of which from the lateral surfaces to the flow-through openings being of concave configuration, the flow-through openings being disposed along a circular arc and of a size such that the mass of the cutter knife is reduced by about 15% to 30% and the surface area of the cutter knife from which heat would be transferred is reduced by about 20% to about 50%.

The cutter knife in accordance with the invention is provided in its side surfaces with openings extending transversely of the cutting edge. That is to say, the openings which may have different surface structures generate transverse flows which tear open the layers of sausage dough engaging the knife surface. The surfaces of the knife acting as heat transfer surfaces are reduced. At the same time, the mass of the cutting blade is reduced, and turbulent flow between individual cutter knives is increased.

Advantageously, the transverse openings in the cutter knives ensure that meat added will penetrate into the openings and will be deflected, and will be propelled or expelled out of the openings, resulting in repeated kneading of the meat and turbulent mixing action. The flow-through and expulsion from the openings, or the deflection of the raw material flows, result in a rupturing of the sausage dough film or prevents the formation of a film of dough on the lateral surfaces of the cutter knife. This, in turn, significantly reduces the transfer of heat from the cutter knife. The reduced heat transfer resulting from the reduced surface area of the cutter knife as well as the lower temperature exchange between the knife and the dough maintain the temperature below the denaturation point of 42° C. As protein chains remain active, the quality of the sausage dough is improved.

The quantity of water or ice otherwise to be added may be significantly reduced as a result of the intensified mixing process of the sausage dough, without causing to excessive cutting the dough. The attained emulsion of the sausage dough is highly stable. This, in turn, means that the cutting time could be extended to increase the degree of fineness, i.e., to reduce the particle size of the dough without detrimentally influencing the production and the final product.

Reducing the quantity of ice increases the life expectancy of the cutter knife, and cutter knives structured in accordance with the invention allow maximum cutter rotations far in excess of 5,000 r.p.m. without causing the dough to be burned which, in turn, gives it a dull appearance and causing the the dough to form lumps.

Another advantage of the cutter knife in accordance with the invention is that if the knives are arranged in pairs or in combination of multiples. The novel knife will positively affect the diminution process, the emulsification and the final quality of the product.

BRIEF DESCRIPTION OF THE SEVERAL DRAWINGS

The novel features which are considered to be characteristic of the invention are set forth with particularity in the appended claims. The invention itself, however, in respect of its structure, construction and lay-out, as well as manufacturing techniques, together with other objects and advantages thereof, will be best understood from the following description of preferred embodiments when read in connection with the appended drawings, in which:

DETAILED DESCRIPTION OF PREFERRED EMBODIMENTS

Figure 1:
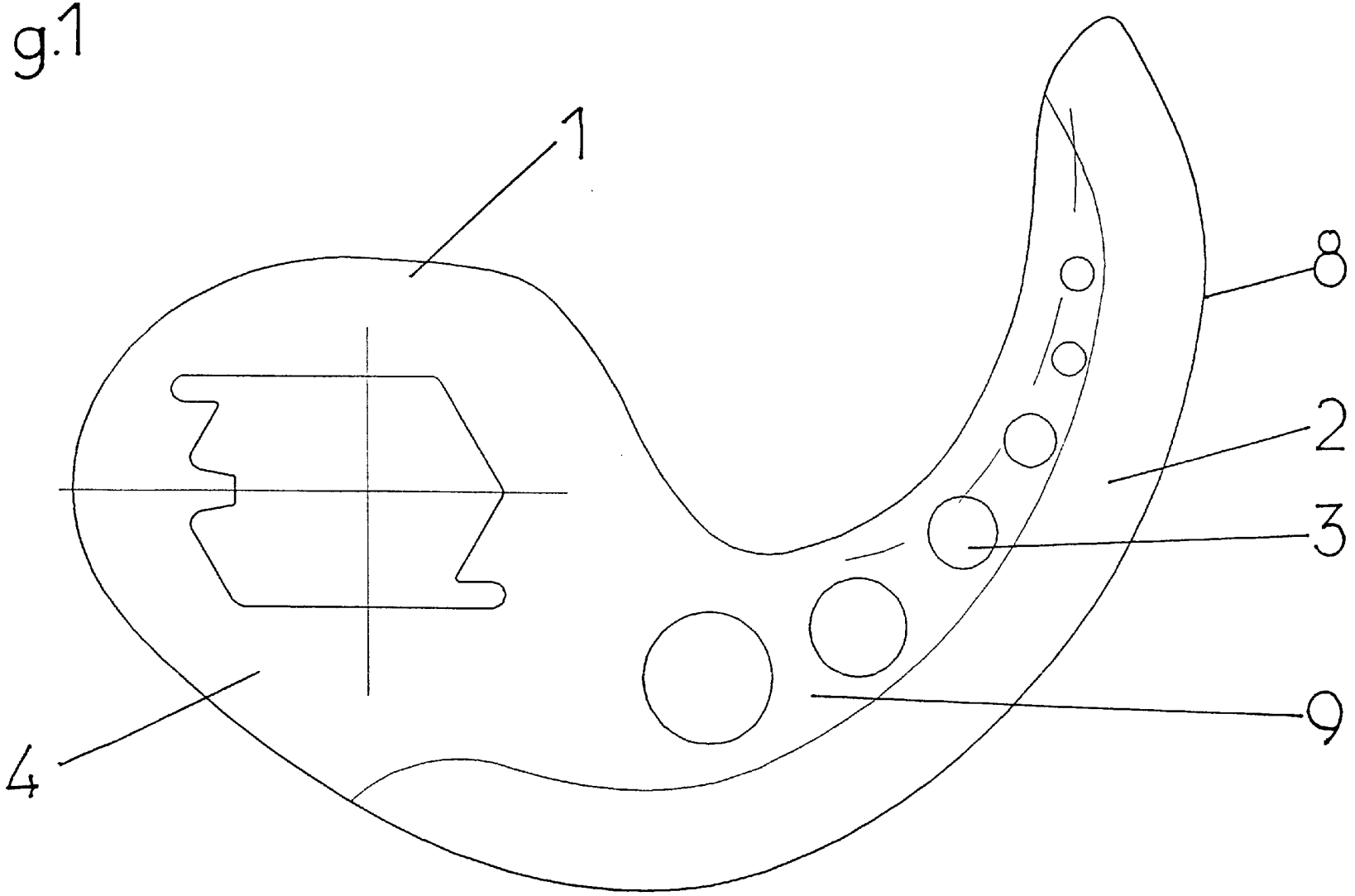
FIG. 1 depicts a cutter knife with openings therein.

A cutter knife 1 in accordance with the invention substantially consists of a blade 2 of a convex or sickle-like structure provided at its forward margin with a cutting edge 8. At its wider end the knife 1 is provided with a recess 4 for mounting it on a knife shaft and aligning it relative thereto.

At its lateral surfaces 9 the cutter knife 1 is provided with penetrating openings or perforations 3 disposed along an arcuate line extending substantially parallel to the arc of the cutting edge 8. The perforations 3 may be of different cross-sectional configurations, a circular cross-section being currently preferred. Not only may the be of different configurations, but may also be of different sizes.

Figure 2:
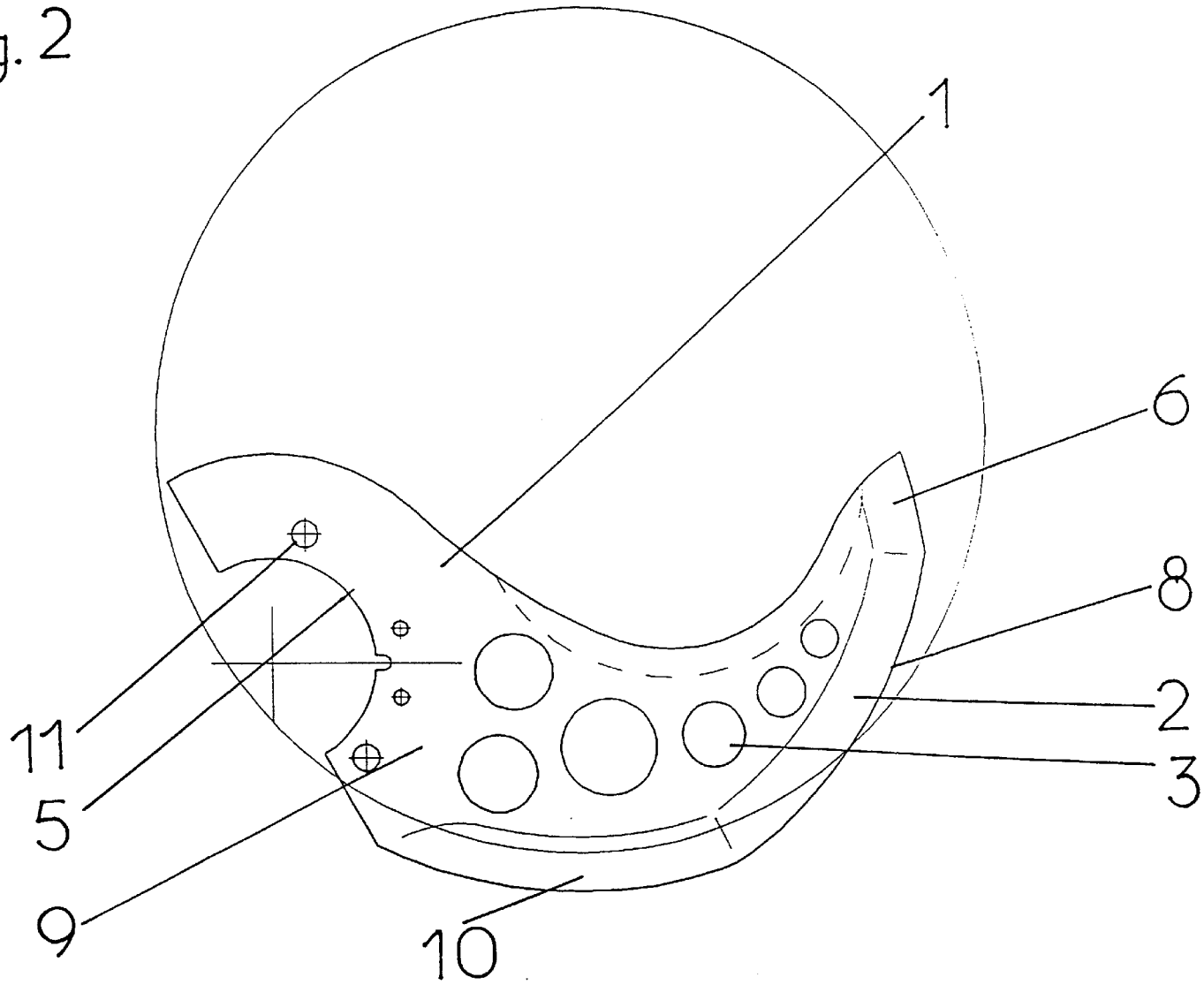
FIG. 2 depicts another embodiment of a cutter knife having openings therein.

The pattern in which the perforations 3 are distributed over the lateral surface 9 depends upon the configuration and size of the convex blade 2. An exemplary arrangement of different sizes and surface distribution is depicted in FIG. 2. In the embodiment of FIG. 2, the convex blade 2 is provided with a beveled tip 6 and an auxiliary cutting edge 10 deviating from the radius of the cutting edge 8.

This embodiment also depicts another kind of structure for mounting of the cutter knives 1 on a knife shaft. In this case, the cutter knife 1 is provided at its wider end with a circular recess 5 and mounting openings 11 for mounting and aligning individual cutting knives 1 as well as combinations of different cutter knives 1 on a knife shaft (not shown).

Figure 3:
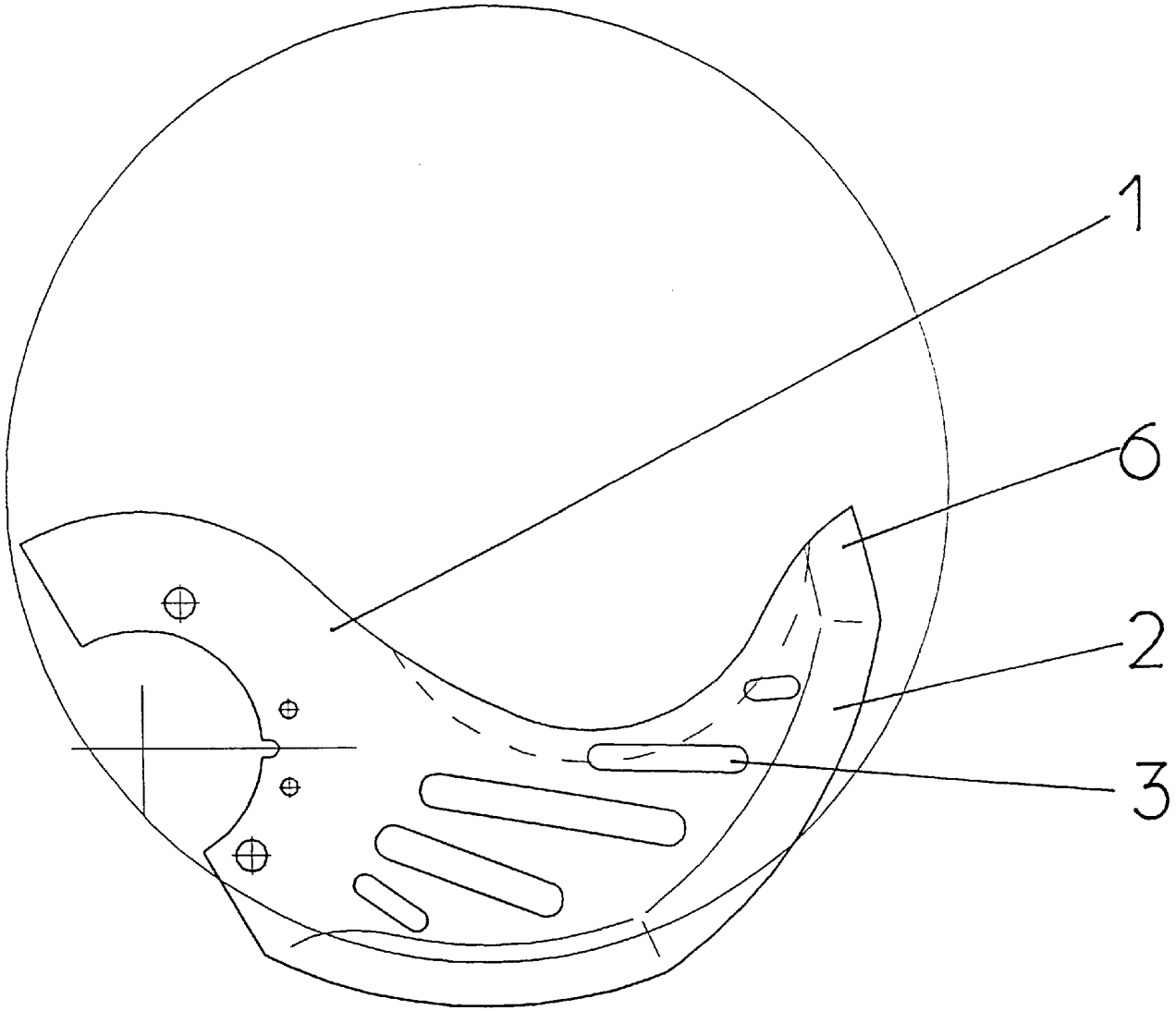
FIG. 3 depicts a cutter knife with elongate openings therein.

Aside from being of circular cross-section, the perforations 3 may be of various different shapes or configurations. In FIG. 3, there is shown a cutter knife 1 provided with elongate perforations 3 arranged in the lateral surfaces 9 of the cutter knife 1 so as generally to be disposed along the line of curvature of the blade 8.

Figure 4:
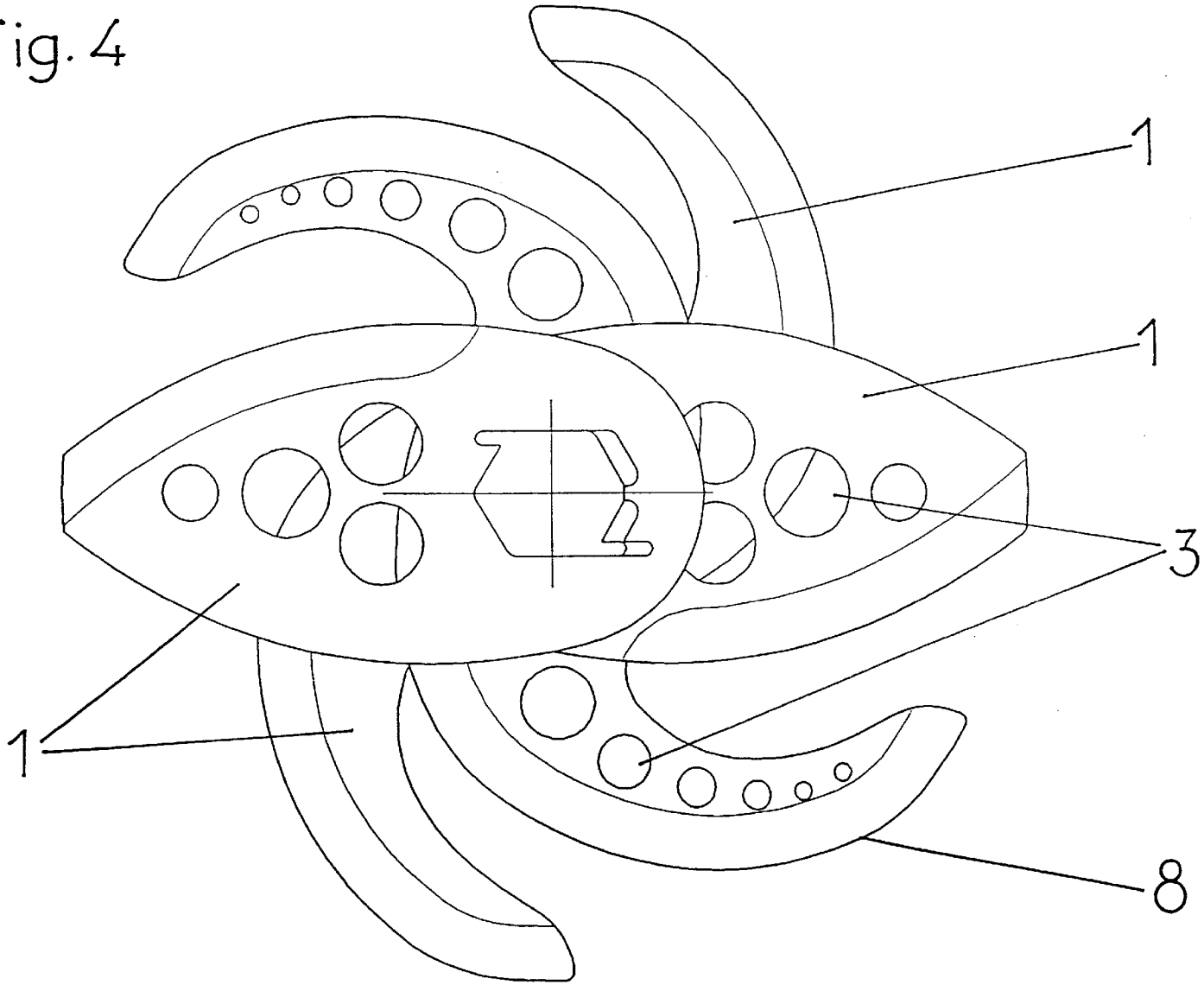
FIG. 4 is a side elevation of an arrangement including a plurality of cutter knives.

FIG. 4 depicts an arrangement or pairing of differently structured cutter knives 1. In this instance, convex as well as S-shaped and substantially oval cutter knives 1 are arranged in pairs affixed to and positioned on the knife shaft (not shown) by a receiving pin 7. All cutter knives 1 shown are provided with perforations 3, and it will be understood that as the cutter knives 1 rotate, the material to be chopped will be deflected several times by the plurality of perforations 3 which advantageously enhances the mixing operation.

The perforations 3 may in the widest sense be considered to constitute flow-through channels or flow-through openings through which the material to be chopped is flowing. The flow direction of the material is deflected by the perforations 3 as well. The perforations 3 are particularly effective in multiple arrangements of individual cutter knives 1, such as shown in FIG. 4 for instance, resulting in a mass flow exchange of the material to be chopped. Preferably, the perforations 3, in longitudinal section, are of concave configuration to avoid formation of sharp edges at the lateral surfaces 9 of the cutter knives 1. In this manner the flow of the material will not be deflected abruptly or along sharp edges but homogeneously, and will be fed to the cutting edge 8 of the associated cutter knife 1.

The arrangement of the perforations 3 over the lateral surfaces 9 of the cutter knives 1 leads to a reduction by about 20% to 50% of the heat transfer surface of the novel cutter knife 1 relative to a solid knife of comparable size. This, in turn, leads to a reduction of about 15% to 30% of the mass of the cutter knives 1 relative to conventional knives. Hence, heat accumulation and retention on the lateral surfaces 9 of the cutter knives 1 is reduced so that the temperature of the sausage dough may be raised by 8° C. to 10° C. without impairing quality.

As mentioned supra, the perforations 3 may have various cross-sections. In addition to their currently preferred circular configuration, the perforations 3 may be configured as triangles, squares, ovals, elongations, rectangles or trapezoids.

We claim:

1. A cutter knife adapted to be mounted on a rotatably driveable knife shaft of a cutter machine, comprising:

a blade comprising two opposite lateral surfaces providing at least one convexly curved margin for forming a cutting edge;

a plurality of openings penetrating through the lateral surfaces and disposed in a predetermined orientation relative to the cutting edge, the walls of the openings being in longitudinal section of substantially concave configuration extending between the lateral surfaces thereby to to provide a smooth transition with each of the lateral surfaces of the blade.

2. The cutter knife of claim 1, wherein the openings are disposed along a line extending substantially parallel to the cutting edge.

3. The cutter knife of claim 2, wherein the cutting edge is of substantially circular configuration.

4. The cutter knife of claim 1, wherein the openings are of substantially circular cross section.

5. The cutter knife of claim 1, wherein the openings are of substantially elongate cross section.

6. The cutter knife of claim 1, wherein the openings are of a volume reducing the mass of the blade by from about 15% to about 30%.

7. The cutter knife of claim 1, wherein the openings reduce the area of the lateral surfaces of the blade by about 20% to about 50%.

8. The cutter knife of claim 1, wherein the blade is provided with a beveled tip.

9. The cutter knife of claim 1, wherein the cutting edge comprises first and second sections disposed at a predetermined angle relative to each other.

* * * * *